US009135886B2

(12) United States Patent
Kirchner et al.

(10) Patent No.: US 9,135,886 B2
(45) Date of Patent: Sep. 15, 2015

(54) COLOUR CALIBRATION OF ELECTRONIC DISPLAY SCREENS

(75) Inventors: Eric Jacob Jan Kirchner, Leiden (NL); Ivo Bernardus Nicolaas Van Der Lans, Den Hoorn (NL); Swie Lan Njo, Oegstgeest (NL); André Half, Beverwijk (NL); Roelof Johannes Baptist Gottenbos, Leiderdorp (NL)

(73) Assignee: AKZO NOBEL COATINGS INTERNATIONAL B.V., Arnhem (NL)

( * ) Notice: Subject to any disclaimer, the term of this patent is extended or adjusted under 35 U.S.C. 154(b) by 279 days.

(21) Appl. No.: 13/577,077

(22) PCT Filed: Feb. 10, 2011

(86) PCT No.: PCT/EP2011/051921

§ 371 (c)(1),
(2), (4) Date: Sep. 10, 2012

(87) PCT Pub. No.: WO2011/098502

PCT Pub. Date: Aug. 18, 2011

(65) Prior Publication Data

US 2013/0010009 A1 Jan. 10, 2013

Related U.S. Application Data

(60) Provisional application No. 61/303,768, filed on Feb. 12, 2010.

(30) Foreign Application Priority Data

Feb. 12, 2010 (EP) ..... 10153397

(51) Int. Cl.
*G09G 5/02* (2006.01)

(52) U.S. Cl.
CPC ..... *G09G 5/02* (2013.01); *G09G 2320/0606* (2013.01); *G09G 2320/0666* (2013.01)

(58) Field of Classification Search
USPC ..... 345/76, 77, 82, 83, 87–89, 204, 690
See application file for complete search history.

(56) References Cited

U.S. PATENT DOCUMENTS

| | | | | |
|---|---|---|---|---|
| 5,670,985 | A * | 9/1997 | Cappels et al. | 345/601 |
| 5,786,803 | A * | 7/1998 | Hernandez et al. | 345/600 |
| 5,956,015 | A * | 9/1999 | Hino | 345/600 |
| 6,036,317 | A | 3/2000 | Seegers et al. | |
| 2008/0260246 | A1 * | 10/2008 | Suzuki et al. | 382/167 |
| 2009/0141042 | A1 * | 6/2009 | Shannon et al. | 345/600 |

FOREIGN PATENT DOCUMENTS

| | | | |
|---|---|---|---|
| DE | 197 55 655 | | 6/1999 |
| DE | 19755655 | A1 * | 6/1999 |
| EP | 1 137 294 | A2 | 9/2001 |
| EP | 1137294 | A2 * | 9/2001 |
| WO | 2007/127057 | A2 | 11/2007 |

OTHER PUBLICATIONS

R.S. Berns, Billmeyer and Saltzmann's, Principles of Color Technology, Third Edition, Wiley-Interscience, New York, 2000, pp. 222-223.

European Search Report for EP 10 15 3397, search completed on Mar. 16, 2010.

International Search Report and Written Opinion for PCT/EP2011/051921, mailed on Apr. 14, 2011.

* cited by examiner

*Primary Examiner* — Charles V Hicks
*Assistant Examiner* — Jeffrey S Steinberg
(74) *Attorney, Agent, or Firm* — Kenyon & Kenyon LLP

(57) ABSTRACT

Process of color calibrating an electronic display screen comprising the steps of displaying at least one trial color of at least one physical sample having standardized color on an electronic display screen, visually comparing the color of the at least one physical sample and the at least one trial color displayed on the electronic display screen, selecting the trial color having the best visual match with the at least one physical sample, and using the selected trial color on the electronic display screen having the best visual match with the at least one physical sample color to color calibrate the electronic display screen.

20 Claims, No Drawings

COLOUR CALIBRATION OF ELECTRONIC DISPLAY SCREENS

REFERENCE TO RELATED APPLICATIONS

This application is the U.S. National Phase of PCT/EP2011/051921 filed on Feb. 10, 2011, and claims the benefit of U.S. Provisional Application No. 61/303,768, filed on Feb. 12,2010.

The invention relates to a process of colour calibrating an electronic display screen.

In numerous industries, the accurate display of colours on electronic display screens, such as computer monitors, is an important issue. Generally, the colour of displayed images on electronic display screens needs to be an accurate representation of the colour of physical samples, for example in the graphical industry, the textile industry, or the paint industry.

A process for colour calibrating electronic display screens is known from International patent publication WO 2007/127057. This document relates to a method for maintaining visual colour performance of displays. According to the known method, calibration is based on data generated by colour measuring devices that measure the colour characteristics of a series of test images displayed on the electronic display screen.

A drawback of the known method is that electronic colour measuring devices are required. Such devices are expensive and potentially fragile. Furthermore, such measurement devices are subject to drifting of measurement accuracy, i.e. they require calibration themselves. In the known method, the colour measurement devices measure the colour characteristics of displayed images directly on the display screen. Environmental conditions, such as the lighting conditions or the viewing angle of a human viewing the display screen, are not taken into account. However, in practice the perceived colour of an image displayed on an electronic display screen depends on lighting conditions and viewing angle. Therefore, the known technique may require complementation by measurement of aspects of the local conditions, such as the intensity and spectrum of the illumination.

U.S. Pat. No. 5,956,015 relates to colour matching a display output in the monitor with a hard copy on an image carrying medium.

The present invention seeks to provide a process of colour calibrating an electronic display screen which does not require an electronic colour measurement device. Furthermore, the process needs to be able to easily account for environmental conditions, such as illumination conditions and viewing angle. The process should likewise require a minimum of steps and lead to a reliable calibration.

The invention provides a process of colour calibrating an electronic display screen comprising the steps of a) providing at least one physical sample having a standardized colour, b) providing software for displaying the colour of the at least one physical sample on an electronic display screen and for adjusting the displayed colour, c) displaying at least one trial colour of the at least one physical sample having a standardized colour on an electronic display screen, d) visually comparing the colour of the at least one physical sample and the at least one trial colour displayed on the electronic display screen, e) optionally, adjusting the at least one trial colour displayed on the electronic display screen to optimize the colour match between the physical sample having a standardized colour and the trial colour displayed on the electronic display screen, f) selecting the trial colour having the best visual match with the at least one physical sample, and g) using the selected trial colour on the electronic display screen having the best visual match with the at least one physical sample colour to colour calibrate the electronic display screen, wherein a modified sRGB model is used in the calibration process, wherein at least two, preferably at least three of the coloristic parameters $Y_{R,\,max}$, $Y_{G,\,max}$, and $Y_{B,\,max}$ and $(x_R, y_R)$, $(x_G, y_G)$, and $(x_B, y_B)$ are optimized.

The optimization of the parameters in step g is carried out with respect to an improved visual match of the selected physical sample and the colour displayed on the electronic display screen.

Steps d to e, or steps d to f, or steps d to g may be executed in an iterative process.

The process of the invention does not require an electronic colour measurement device and can therefore easily be implemented. Furthermore, as the process is based on visual comparison of a physical sample and a displayed image on an electronic display screen, local conditions such as the intensity of illumination and the spectral properties of the illuminating light are inherently taken into account.

It is a known phenomenon that the visual colour perception of physical objects as well as of images displayed on physical display screens can vary with the intensity and spectral properties of illumination. While prior art methods for calibration of displays ignore such variation, or involve crude estimations or measurements of illumination conditions, the method of the invention is able to account for them as far as they have an influence on the visual perception of samples.

As mentioned above, the process of the invention uses at least one physical sample having a standardized colour. Having a standardized colour means that the colorimetric properties of the sample, for example the reflection spectrum, are known, implemented in the computer software or in the accompanying data storage used in the process of the invention, and that the colorimetric properties of the physical sample are acceptably stable over time.

In one embodiment, the user provides his own standardized colours and measurements thereof.

The at least one physical sample having a standardized colour may have any suitable shape. In one embodiment, the sample may have a three-dimensionally contoured surface structure. Generally, the physical sample will be provided in the form of an essentially flat panel. The physical sample provided in the form of an essentially flat panel may have the shape of a polygon or it may have curved contours, or combinations thereof. The most suitable shape and size of the physical sample may also depend on the size and shape of the colour displayed on the electronic display screen. In step d) of the process of the invention, the physical sample is generally positioned close to the electronic display screen, for example at a distance of less than 15 cm, or less than 10 cm, or even less than 1 cm from the electronic display screen. When the physical sample is an essentially flat panel, it is advantageous to position the physical sample relative to the display screen such that the planes of the sample and of the screen are in parallel. It is possible to provide a holder for the physical sample which allows the physical sample to be fixed in a desired position relative to the electronic display screen. In a further embodiment, the sample holder additionally comprises so-called visors to ensure a defined angle and/or position of the eyes of the observer relative to the physical sample and the electronic display screen.

An acceptable colour calibration of an electronic display screen can be obtained when the process of the invention is carried out with a single physical sample having a standardized colour. However, an improved calibration can be achieved when the process is reiterated with at least a second physical sample having a different standardized colour from the first physical sample. When a reiteration with at least a second physical sample is carried out, it is preferable that the standardized colour of the first physical sample is relatively distant in colour space from the standardized colour of the second physical sample. Further improvements of the calibration can be achieved by further iterations of the process with a third, fourth, or even further physical samples all having different standardized colours. It is generally possible to reiterate the process with a large number of physical samples in order to optimize the accuracy of the calibration. However, it will be understood that it is desirable to minimize the number of iterations required for an acceptable accuracy of calibration. Suitably, the process is reiterated with at most 20, or at most 10 different physical samples.

Alternatively, instead of using reiterations, it is possible to carry out the process with a plurality of different physical samples simultaneously. In this case, at least two physical samples may be provided simultaneously, for each of the at least two physical samples at least one trial colour is displayed, and all trial colours are displayed simultaneously.

In one embodiment, one trial colour of the at least one physical sample is displayed in step c) on the electronic display screen for comparison with the physical sample. In an alternative embodiment, in step c) a plurality of trial colours with mutual colour differences are displayed simultaneously on the electronic display screen. Typically, between 2 and 12 coloured images may be displayed simultaneously on the display screen. These coloured images may differ from each other by small steps along different directions in colour space, such as CIE-L* or CIE-C*.

The coloured images may be arranged on the electronic display screen along the boundary edges of a polygon formed by the physical sample. For example, if there are 6 coloured images, they are arranged in a hexagonal arrangement such that the physical sample, which in this case would be a regular hexagon, can be placed in the centre, with a displayed colour image bordering to each of the six sides of the physical sample. In this way, the user can easily compare each displayed colour image with the physical test sample visually and select the one that is closest to it with respect to colour. Based on this input, the software changes the colours of all displayed colour images, and after a few iterations the user will have found the optimum colour match between the coloured images and the physical test sample, which information is then used to calibrate the electronic display screen.

In a further embodiment, the displayed trial colours exhibit a colour gradient. The trial colours may be displayed in the form of one or more bars, wherein in each bar the colour is systematically varied in a direction of colour space that differs for each bar. For example, one bar could show colour variations along the CIE-L* axis, and a next bar could show colour variations along the CIE-C* axis. The user visually compares the physical sample to the colours shown in a bar, and selects the colour in the bar that is closest to the colour appearance of the physical sample. In an iterative process, this results in increasingly improved colour matches. Based on this information, the electronic display screen can be calibrated.

In the actual calibration process, the input data that was provided by the user is analyzed, while on the electronic display screen the trial colour having the best visual match with the at least one physical sample colour is selected. Based on this analysis, any colour displayed on the electronic display screen after finishing the calibration procedure is modified such that its colour appearance will have the best possible match with the corresponding physical sample. Thus, colour calibration of the electronic display screen is achieved. In one embodiment, the accuracy of the calibration is further improved by optimizing the procedure specifically for one or more colour regions of special interest, and allowing for less accuracy in colour regions of less interest.

A further embodiment of the process of the invention comprises the additional step of ascertaining the expertise level of the operator. The number of physical samples or the number of displayed trial colours used in the calibration process may then be selected based on the expertise level of the operator.

As a basis for the data analysis that is part of the process of colour calibration a number of more or less well-known mathematical relationships can be used. In the so-called sRGB model, which is the most common standard for displaying colours on an electronic display device, the following relation is assumed to be valid (see for example page 222 in: R. S. Berns, *Billmeyer and Saltzmann's Principles of Color Technology*, Third Edition, Wiley-Interscience, New York, 2000):

$$\begin{pmatrix} X \\ Y \\ Z \end{pmatrix} = \begin{pmatrix} m_{11} & m_{12} & m_{13} \\ m_{21} & m_{22} & m_{23} \\ m_{31} & m_{32} & m_{33} \end{pmatrix} \begin{pmatrix} R \\ G \\ B \end{pmatrix} \tag{1}$$

Here, the parameters R, G, and B are related to the digital values $d_R$, $d_G$, and $d_B$ of the Red, Green, and Blue channels, which each typically have a discrete value between 0 and 255. In the sRGB model, the relationship between the parameters R, G, and B in equation (1) and the digital values $d_R$, $d_G$, and $d_B$ is assumed to be as follows:

$$\begin{pmatrix} R \\ G \\ B \end{pmatrix} = \begin{pmatrix} (k_{1,R} d_R + k_{2,R})^{\gamma_R} \\ (k_{1,G} d_G + k_{2,G})^{\gamma_G} \\ (k_{1,B} d_B + k_{2,B})^{\gamma_B} \end{pmatrix} \tag{2}$$

In equation (2),

If $d_R, d_G$ or $d_B > 255*0.04045$, then $$Y_R = Y_G = Y_B = 2.4$$

$$k_{1,R} = k_{1,G} = k_{1,B} = 1/(255*1.055)$$

$$k_{2,R} = k_{2,G} = k_{2,B} = 0.055/1.055$$

else $$Y_R = Y_G = Y_B = 1.0$$

$$k_{1,R} = k_{1,G} = k_{1,B} = 1/(255*12.92)$$

$$k_{2,R} = k_{2,G} = k_{2,B} = 0.0 \tag{3}$$

Further, in equation (1) the parameters X, Y, and Z are the tristimulus values, well known to those skilled in the art.

Reflection data from any coloured sample can be converted into X, Y, and Z values by standard methods. Subsequently, it is possible to calculate from the X, Y, and Z values the R, G, and B values required for displaying the colour on an electronic display device, by mathematically inverting equation (1):

$$\begin{pmatrix} R \\ G \\ B \end{pmatrix} = \begin{pmatrix} n_{11} & n_{12} & n_{13} \\ n_{21} & n_{22} & n_{23} \\ n_{31} & n_{32} & n_{33} \end{pmatrix} \begin{pmatrix} X \\ Y \\ Z \end{pmatrix} \tag{4}$$

where $$\begin{pmatrix} n_{11} & n_{12} & n_{13} \\ n_{21} & n_{22} & n_{23} \\ n_{31} & n_{32} & n_{33} \end{pmatrix} = \frac{1}{\mathrm{Det}(M)} \begin{pmatrix} (m_{22}m_{33} - m_{23}m_{32}) & -(m_{21}m_{33} - m_{23}m_{31}) & (m_{21}m_{32} - m_{22}m_{31}) \\ -(m_{12}m_{33} - m_{13}m_{32}) & (m_{11}m_{33} - m_{13}m_{31}) & -(m_{11}m_{32} - m_{12}m_{31}) \\ (m_{23}m_{12} - m_{22}m_{13}) & -(m_{11}m_{23} - m_{13}m_{21}) & (m_{22}m_{11} - m_{21}m_{12}) \end{pmatrix} \tag{5}$$

and where Det(M) denotes the mathematical determinant of the matrix appearing in equation (1).

This shows that once the parameters $m_{11}$ up to $m_{33}$ are known for a particular electronic display device, a measurement of reflection values for any coloured object can be converted into the $d_R$, $d_G$, and $d_B$ values required for displaying its colour on the display device.

In the commonly used sRGB model, the parameters $m_{11}$ up to $m_{33}$ have fixed values. A commonly used set of values is the following:

$$m_{11}=0.4124 \quad m_{12}=0.3576 \quad m_{13}=0.1805$$

$$m_{21}=0.2126 \quad m_{22}=0.7152 \quad m_{23}=0.0722$$

$$m_{31}=0.0193 \quad m_{32}=0.1192 \quad m_{33}=0.9505 \tag{6}$$

Using standard colorimetry, it can be shown that the parameters $m_{11}$ up to $m_{33}$ are related to the coloristic characteristics of the electronic display device by the following relation:

$$\begin{pmatrix} m_{11} & m_{12} & m_{13} \\ m_{21} & m_{22} & m_{23} \\ m_{31} & m_{32} & m_{33} \end{pmatrix} = \begin{pmatrix} \frac{x_R}{y_R} Y_{R,max} & \frac{x_G}{y_G} Y_{G,max} & \frac{x_B}{y_B} Y_{B,max} \\ Y_{R,max} & Y_{G,max} & Y_{B,max} \\ \frac{z_R}{y_R} Y_{R,max} & \frac{z_G}{y_G} Y_{G,max} & \frac{z_B}{y_B} Y_{B,max} \end{pmatrix} \tag{7}$$

Here, $Y_{R,\,max}$, $Y_{G,\,max}$, and $Y_{B,\,max}$ are the maximum luminance of the Red, Green, and Blue channels of the device, respectively. Further, coordinates $(x_R,y_R)$, $(x_G, y_G)$, and $(x_B, y_B)$ refer to the chromaticity coordinates x, y of the Red, Green, and Blue channels of the device, respectively.

In one version of the standard sRGB model, the choice of the parameter values as given in equation (6) is equivalent to assuming that the Red channel of the display device has chromaticity coordinates equal to $(x_R,y_R)=(0.64, 0.30)$, and a maximum luminance $Y_{R,\,max}=21.26$ cd/m$^2$. Similarly, the sRGB model assumes that the Green channel of the electronic display device has $(x_G,y_G)=(0.33, 0.6)$ and a maximum luminance $Y_{G,max}=71.52$ cd/m$^2$. Finally, the sRGB model assumes that the Blue channel of the electronic display device has $(x_B,y_B)=(0.03, 0.10)$ and a maximum luminance $Y_{B,max}=7.22$ cd/m$^2$.

Other sets of fixed values of the model parameters are known as well. The crucial point made here is that a given set of parameter values is assumed to be valid for a whole class of electronic display devices, without accounting for the coloristic differences between individual display devices and local illumination and observation conditions.

In the proposed colour calibration method of electronic display devices, improved colour accuracy of particular electronic display devices is achieved by optimizing physical parameters that were found to be most relevant for colour calibrating the electronic display screen, instead of either numerically optimizing the mathematical parameters $m_{11}$ up to $m_{33}$ defined in equation (1), or using the standard sRGB parameter values listed in equations (6) and (3). In the proposed calibration method, the values of the physical parameters are optimized for any specific display device and/or viewing and illumination condition.

A known approach to optimizing the model parameters of the calibration model of electronic display devices is to directly optimize the parameters $m_{11}$ up to $m_{33}$ in equation (1). However, this approach has the disadvantage that all nine parameters $m_{11}$ up to $m_{33}$ are treated with equal priority. In this way, a relatively large number of samples is needed for colour calibration. Another disadvantage of this known procedure of optimizing the parameters of the calibration model is that this procedure easily leads to combinations of values for the $m_{11}$-$m_{33}$ parameters that correspond to physically unrealistic or even impossible combinations of values for the related coloristic parameters $Y_{R,\,max}$, $Y_{G,\,max}$, and $Y_{B,\,max}$ and $(x_R, y_R)$, $x_G$, $y_G$), and $(x_B,y_B)$. For example, certain combinations of values for the parameters $m_{11}$-$m_{33}$, which may result from an optimization on these parameters, correspond to values of the coloristic parameters $(x_R, y_R)$ and $(x_G, y_G)$ that would make the Red channel of the display device be actually green, and vice versa.

In prior art methods either fixed values are used for the sRGB values, or the nine parameters $m_{11}$-$m_{33}$ are all optimized in the calibration process. In contrast to this, in the new method a selection from the nine coloristic parameters $Y_{R,\,max}$, $Y_{G,\,max}$, $Y_{B,\,max}$, $x_R$,$y_R$, $x_G$, $y_G$, $x_B$, $y_B$ is directly optimized. From these parameters, we have identified those parameters that are most relevant for colour calibration of electronic display screens. By limiting the optimization to those parameters, fewer samples are needed for colour calibration, and optimization is less likely to lead to physically unrealistic or impossible numerical values than when prior art methods are used for colour calibration. Accordingly, it is preferred that the coloristic parameters are optimized so as to avoid physically unrealistic or even impossible combinations of values.

In one embodiment, we have chosen to base the colour calibration on a plurality of physical samples with different, known, grey reflection curves. Generally, between 3 and 6 different grey physical samples are used. Grey is to be understood as being an essentially achromatic colour of which the lightness may vary. Colours having a chroma value smaller than 5 units in the well-known CIELab system are generally perceived as grey.

In this embodiment, use is made of the fact that for many electronic display devices the coloristic variation between different display types and between different displays of the same type mainly influences the optimum values of the three coloristic parameters $Y_{R,max}$, $Y_{G,max}$, and $Y_{B,max}$. The values for the parameters $(x_R, y_R)$, $(x_G,y_G)$, and $(x_B,y_B)$ and for the parameters listed in equation (3) are taken from the standard sRGB model. By optimizing the values of $Y_{R,\,max}$, $Y_{G,\,max}$, and $Y_{B,\,max}$ in equation (7), the best match is found between the predicted $d_R$, $d_G$, and $d_B$ values and the $d_R$, $d_G$, and $d_B$ values selected by the user, based on visually matching the colour of the three physical samples with the colour of electronic images.

It was found that by optimizing the values of the $Y_{R,\ max}$, $Y_{G,\ max}$, and $Y_B$, $Y_{B,\ max}$ parameters, based on visual assessment of three physical, greyish samples, a large improvement in the colour accuracy of many electronic display devices is achieved. This method is even capable of accounting for the illumination spectrum of the specific light source used in the visual assessments of the physical samples, although a more accurate method for accounting for the illumination spectrum is by calculating the X, Y, Z values, utilizing spectral data for the specific light source.

In another embodiment, three physical grey samples and six physical coloured samples are used for colour calibration of the electronic display device. In one phase of the calibration process, the three grey samples are used to optimize the three parameters $Y_{R,\ max}$, $Y_{G,\ max}$, and $Y_{B,\ max}$. This procedure is repeated regularly, several times a year, thus avoiding that displayed colours gradually shift over time for the electronic display device.

In another phase of the calibration process, the most recently optimized values of the three parameters $Y_{R,\ max}$, $Y_{G,\ max}$, and $Y_{B,\ max}$ and the sRGB values of the parameters $Y_R$, $Y_G$, $Y_B$ are used as starting values for finding optimized values for these six parameters, by matching the colour of three physical grey samples and six physical coloured samples. This phase of the calibration process may be carried out only once, or it may be repeated for example every year. Also, this part of the calibration process may be carried out by persons well trained in the calibration procedure.

Many such embodiments of the process are possible. Generally, the number of physical samples required to be visually compared to displayed colours by the user is reduced as compared to the conventional case, in which all nine parameters in equation (4) and the nine parameters in equation (3) need to be optimized. This gives a large reduction in costs and time required for colour calibration.

The electronic display screen which can be calibrated according to the process of the invention may be a computer monitor, a projector, a TV screen, a personal digital assistant (PDA) device, a cell phone, a smart phone that combines PDA and cell phone, a flexible thin film display, or any other device that can display information or images based on digital signals. The display device can also be a dual functional display/data input device, such as a touch screen.

The process of the present invention can be implemented in many industries where a precise and correct display of colours on electronic display screens is required. Examples of industries are those where the colour of displayed images on electronic display screens needs to be an accurate representation of the colour of physical samples, such as the graphical industry, the textile industry, or the paint industry. For example, the process can be implemented when it is desired to accurately display the predicted colour of hypothetical paint or colorant compositions, in particular automobile refinish paint compositions which have to match the colour and appearance of the original coating layer.

The invention claimed is:

1. A process of color calibrating an electronic display screen comprising the steps of a) providing at least one physical sample having a standardized color, b) providing software for displaying the color of the at least one physical sample on an electronic display screen and for adjusting the displayed color, c) displaying at least one trial color of the at least one physical sample having a standardized color on an electronic display screen, d) visually comparing the color of the at least one physical sample and the at least one trial color displayed on the electronic display screen, e) selecting the trial color having the best visual match with the at least one physical sample, and f) using the selected trial color on the electronic display screen having the best visual match with the at least one physical sample color to color calibrate the electronic display screen, wherein a modified sRGB model is used in the calibration process, wherein at least two of the coloristic parameters YR, max, YG, max, and YB, max and (xR, yR), (xG, yG), and (xB, yB) are optimized.

2. The process according to claim 1, wherein in step f) the coloristic parameters are optimized to avoid physically unrealistic or impossible combinations of values.

3. The process according to claim 1, wherein a plurality of physical samples are provided in step a), wherein the color of each physical sample is grey.

4. The process according to claim 1, wherein the process is reiterated with at least a second physical sample having a different standardized color from the first physical sample.

5. The process according to claim 1, wherein the physical sample having a standardized color is provided in the form of an essentially flat panel.

6. The process according to claim 1, wherein in step c) a plurality of trial colors with mutual color differences are displayed simultaneously on the electronic display screen.

7. The process according to claim 1, wherein at least two physical samples are provided simultaneously, for each of the at least two physical samples at least, one trial color is displayed, and all trial colors are displayed simultaneously.

8. The process according to claim 1, wherein the displayed trial colors exhibit a color gradient.

9. The process according to claim 1, wherein the full calibration process is repeated after a predetermined period of time.

10. The process according to claim 1, further comprising the step of ascertaining the expertise level of an operator and wherein the number of physical samples or the number of displayed trial colors used in the calibration process is selected based on the expertise level of the operator.

11. The process according to claim 1, further comprising the step of adjusting the at least one trial color displayed on the electronic display screen to optimize the color match between the physical sample having a standardized color and the trial color displayed on the electronic display screen.

12. The process according to claim 2, wherein a plurality of physical samples are provided in step a), wherein the color of each physical sample is grey.

13. The process according to claim 11, wherein a plurality of physical samples are provided in step a), wherein the color of each physical sample is grey.

14. The process according to claim 2, wherein the process is reiterated with at least a second physical sample having a different standardized color from the first physical sample.

15. The process according to claim 3, wherein the process is reiterated with at least a second physical sample having a different standardized color from the first physical sample.

16. The process according to claim 11, wherein the process is reiterated with at least a second physical sample having a different standardized color from the first physical sample.

17. The process according to claim 11, wherein the physical sample having a standardized color is provided in the form of an essentially flat panel.

18. The process according to claim 11, wherein in step c) a plurality of trial colors with mutual color differences are displayed simultaneously on the electronic display screen.

19. The process according to claim 11, wherein at least two physical samples are provided simultaneously, for each of the at least two physical samples at least one trial color is displayed, and all trial colors are displayed simultaneously.

20. The process according to claim 11, wherein the displayed trial colors exhibit a color gradient.

* * * * *